US006797229B2

(12) United States Patent
Saarinen et al.

(10) Patent No.: US 6,797,229 B2
(45) Date of Patent: Sep. 28, 2004

(54) APPARATUS FOR REMOVING DUST ACCRETIONS FROM A SMELTING FURNACE

(75) Inventors: Risto Saarinen, Espoo (FI); Eero Hugg, Espoo (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/311,660

(22) PCT Filed: Jun. 20, 2001

(86) PCT No.: PCT/FI01/00590

§ 371 (c)(1),
(2), (4) Date: Dec. 18, 2002

(87) PCT Pub. No.: WO02/01131

PCT Pub. Date: Jan. 3, 2002

(65) Prior Publication Data

US 2004/0012130 A1 Jan. 22, 2004

(30) Foreign Application Priority Data

Jun. 29, 2000 (FI) ..... 20001547

(51) Int. Cl.[7] ..... C21B 9/10
(52) U.S. Cl. ..... 266/135; 266/155
(58) Field of Search ..... 266/135, 155, 266/148

(56) References Cited

U.S. PATENT DOCUMENTS 3,721,217 A 3/1973 Willach et al. ..... 122/379
3,737,554 A 6/1973 Horibe et al. ..... 13/33
4,475,947 A * 10/1984 Andersson ..... 266/44
4,878,654 A 11/1989 Carminati et al. ..... 266/159

FOREIGN PATENT DOCUMENTS

| | | |
|---|---|---|
| DE | 27 10 153 A1 | 9/1978 |
| EP | 0 254 379 A1 | 1/1988 |
| JP | 58-009945 A | 1/1983 |
| JP | 59-093180 A | 5/1984 |
| JP | 63-058100 A | 3/1988 |
| JP | 04-292787 A | 10/1992 |

* cited by examiner

*Primary Examiner*—Scott Kastler
(74) *Attorney, Agent, or Firm*—Morgan & Finnegan, LLP

(57) ABSTRACT

The invention relates to an apparatus for mechanically breaking up and detaching dust accretions created by process gases and accumulated on the inner walls of a suspension smelting furnace and/or a waste heat boiler permanently connected to the suspension smelting furnace. According to the invention, on the outer surface (7,13) of the wall of a suspension smelting furnace (1) and/or a waste heat boiler (6), in the vicinity of the connecting point (5) of the suspension smelting furnace and the waste heat boiler, there is installed at least one striker device (8,14), whereby there can be created a mechanical impact effect and mechanical contact between the apparatus (8,14) and at least one of the dust accretions (12,19).

5 Claims, 2 Drawing Sheets

APPARATUS FOR REMOVING DUST ACCRETIONS FROM A SMELTING FURNACE

Figure 1:
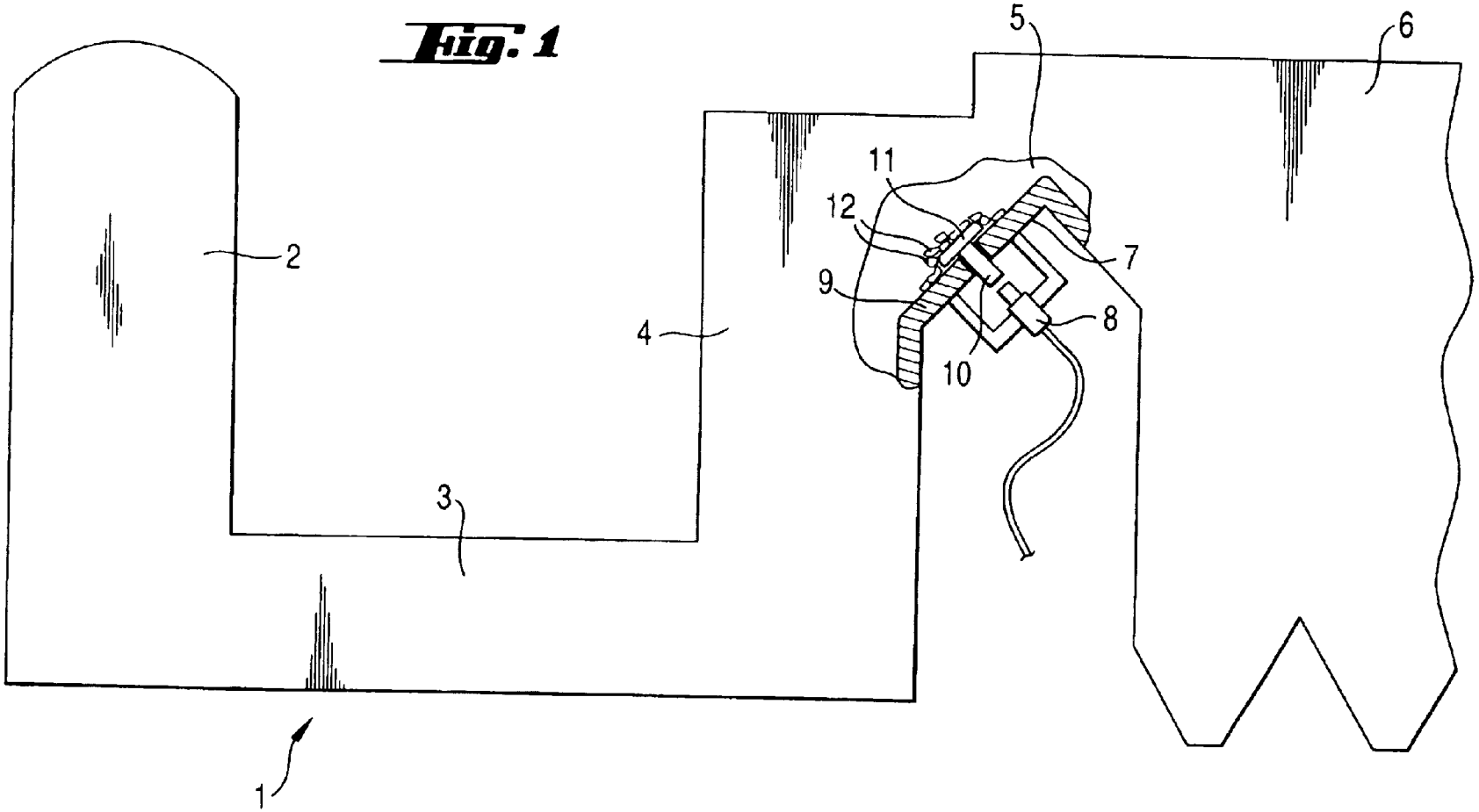

The present invention relates to an apparatus for removing dust accretions from a suspension smelting furnace used in the smelting of sulfidic raw materials, such as ores or concentrates, containing useful metals, such as copper, nickel or lead.

In order to recover metals, such as copper, nickel or lead, from sulfidic raw materials containing said materials, for instance from ores or concentrates, there is generally applied the suspension smelting method, where the heat amounts contained by finely divided sulfidic raw materials are made use of. In addition to sulfidic raw materials, into the reaction space of the suspension smelting furnace there is fed oxygen-containing gas, such as air, oxygen-enriched air or oxygen. In addition, to the reaction space there is fed for instance flue dust recovered and recirculated from the exhaust gases of the suspension smelting furnace, as well as metallurgic slag-forming agent, flux. In the reaction space of the suspension smelting furnace, the solid and gaseous feed materials react with each other, so that in the bottom part of the suspension smelting furnace, there are formed at least two molten phases, a slag phase and a matte phase contained by the metal to be utilized. The molten phases that are formed in the bottom part of the suspension smelting furnace, i.e. in the settler, are removed from the suspension smelting furnace at regular intervals. The sulfur dioxide bearing process gases created in the reaction space of the suspension smelting furnace are conducted, via the settler, to the uptake shaft of the suspension smelting furnace, and from the uptake shaft further to a waste heat boiler connected to the suspension smelting furnace, where the exhaust gases from the suspension smelting furnace are cooled, and at the same time the solids, i.e. flue dust, contained by the gas are removed.

When the suspension smelting furnace exhaust gases are transferred from the uptake shaft of the suspension smelting furnace to the waste heat boiler, the flowing direction of the gases is changed from an essentially vertical direction to an essentially horizontal direction. Moreover, when the flowing area of the connecting aperture between the uptake shaft and the waste heat boiler is made essentially smaller than that of the uptake shaft in order to reduce the heat losses from the suspension smelting furnace, contacts of sulfur dioxide bearing exhaust gases with the walls of the suspension smelting furnace cannot be avoided. Further, because the temperature of the exhaust gases is dropped towards the top part of the uptake shaft of the suspension smelting furnace, the molten particles contained in the exhaust gases start to be solidified, and when touching the uptake shaft walls, they are attached to the wall, particularly in the vicinity of the connecting aperture between the uptake shaft and the waste heat boiler. Thus, in the vicinity of the connecting aperture, there are accumulated dust accretions that obstruct the flowing of the exhaust gases and must therefore be broken apart.

It is an object of the invention to achieve an improved apparatus for breaking up dust accretions created in the vicinity of the connecting point between the uptake shaft and successive waste heat boiler, in the inner parts of the uptake shaft and/or the waste heat boiler, so that the dust accretions do not essentially obstruct the flowing of the exhaust gases from the uptake shaft to the waste heat boiler.

According to the invention, in the vicinity of the connecting point between the uptake shaft of a suspension smelting furnace and the waste heat boiler connected to the uptake shaft, there is installed at least one apparatus, whereby the dust accretions created in the vicinity of the connecting aperture of the uptake shaft and the waste heat boiler can be subjected to an impact effect in order to break up the dust accretions and to drop them back to the bottom part of the uptake shaft of the suspension smelting furnace and/or to the bottom part of the waste heat boiler. The apparatus according to the invention is attached to the wall of the suspension smelting furnace and/or of the waste heat boiler, so that the impact effect achieved by means of the apparatus can be conducted, through the wall of the suspension smelting furnace uptake shaft and/or of the waste heat boiler to at least one dust accretion located inside the uptake shaft and/or waste heat boiler.

In order to break up dust accretions from the inside of the suspension smelting furnace uptake shaft and/or the waste heat boiler, in the vicinity of the connecting point between the suspension smelting furnace uptake shaft and the waste heat boiler, by means of an apparatus according to the invention, in the wall of the uptake shaft and/or the waste heat boiler, on the outer wall surface, in a location corresponding to the spot where the dust accretions are accumulated, there is installed at least one striker device. By means of the striker device, strokes are directed through the wall to the counterpart of the striker device that serves as an anvil. In that end of the counterpart of the striker device, installed through the wall, that is placed inside the uptake shaft and/or the waste heat boiler, which end at the same time is the opposite end with respect to the striker device, there is further installed a striker element whereby a mechanical contact can be achieved between the striker element and the dust accretions to be broken up. The force of the stroke hit by the striker element makes the dust accretions to be broken up and detached from the wall of the uptake shaft and/or the waste heat boiler, so that they are dropped down, to the bottom part of the uptake shaft on the uptake shaft side, and to the bottom part of the waste heat boiler on the waste heat boiler side.

Advantageously the striker device meant for breaking up dust accretions operates pneumatically, hydraulically or in some other advantageous manner. The striker device may advantageously be arranged to operate so that it hits the striker counterpart, serving as the anvil, at essentially regular intervals. Naturally the striker device can also be arranged to operate so that strokes are placed only in cycles, at essentially regular intervals, or so that single strokes are hit according to the need for breaking up the dust accretions, with respect to their degree of accumulation. In addition, the impact force of the striker device provided in the apparatus according to the invention can advantageously be adjusted, in which case the hardness and adhesion caused by the composition of the dust accretions can be taken into account.

Figure 2:
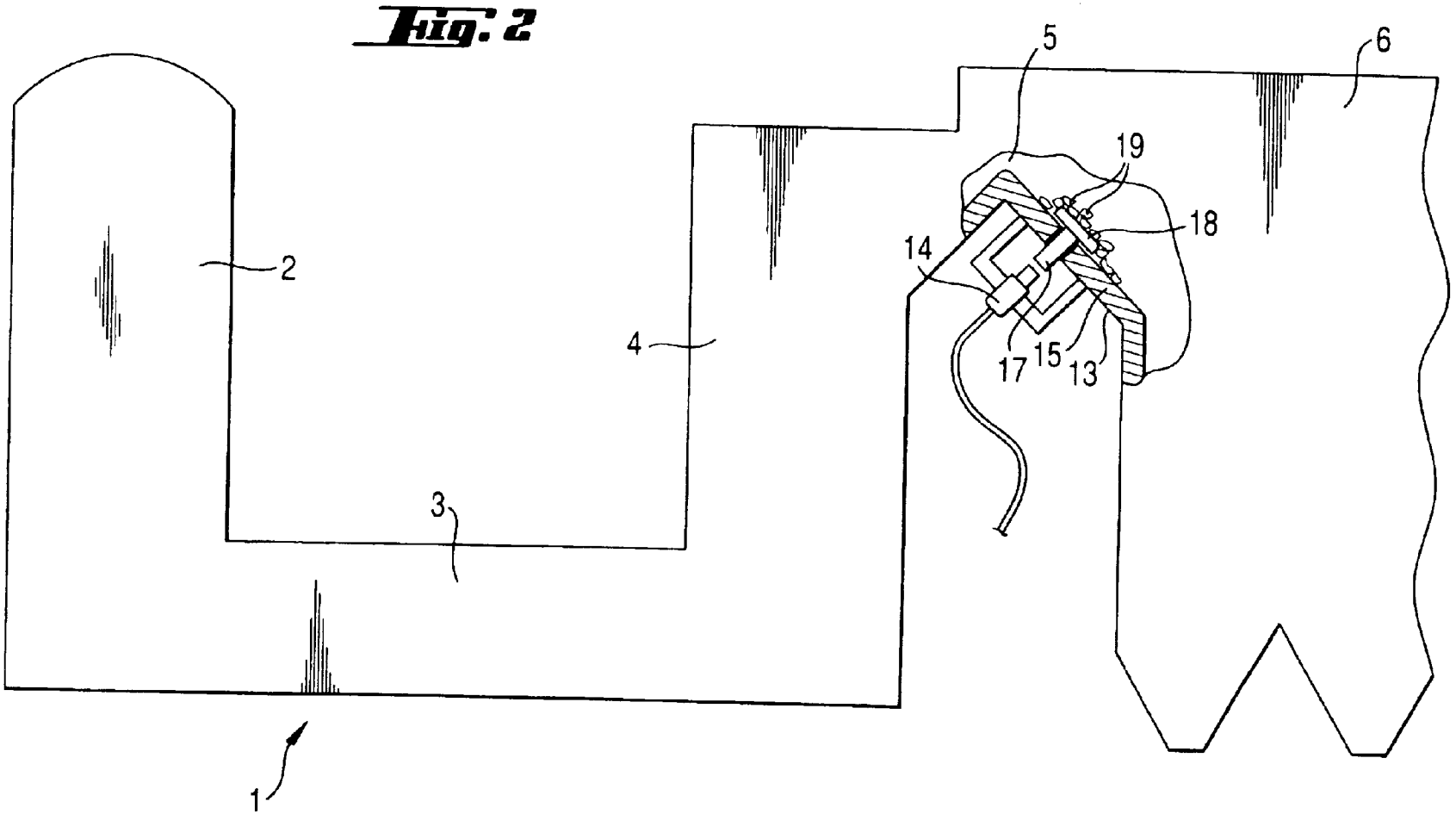

The invention is explained more detail with reference to the appended drawing, where FIG. 1 is a schematical side-view illustration of a preferred embodiment of the invention, seen in a partial cross-section, and FIG. 2 is a schematical side-view illustration of another preferred embodiment of the invention, seen in a partial cross-section.

According to FIG. 1, the sulfur dioxide bearing gases that are created during the smelting that takes place in the reaction space 2 of a suspension smelting furnace 1 are exhausted through the settler 3 to the uptake shaft 4 of the suspension smelting furnace. The uptake shaft 4 is, via the aperture 5, connected to the waste heat boiler 6 in order to cool down the sulfur dioxide bearing exhaust gases and in order to recover the solids that are exhausted along with the gases. In the vicinity of the aperture 5 between the uptake shaft 4 and the waste heat boiler 6, on the outer surface 7 of the wall of the uptake shaft 4, there is installed striker device 8. In order to enable the desired operation of the striker device 8, in an aperture arranged in the wall 9 of the uptake shaft 4, there is installed a counterpart 10 of the striker device 8, which counterpart serves as the anvil. At that end of the counterpart 10 that is left inside the uptake shaft 4, there is further installed an impact plate 11.

When the striker device 8 is used for breaking up the dust accretions 12 accumulated inside the uptake shaft 4, the striker device 8 hits the counterpart 10, which moves in parallel to the aperture arranged in the wall of the uptake shaft 4. The counterpart 10 further moves the impact plate 11, which directs an impact to the dust accretions 12. Owing to the force of the impact, the dust accretions 12 are broken up and dropped downwardly in the uptake shaft 4.

According to FIG. 2, on the outer surface 13 of a waste heat boiler 6 connected to the uptake shaft 4 of a suspension smelting furnace 1 via an aperture 5, there is installed striker device 14. In order to enable the desired operation of the striker device 14, in an aperture arranged in the wall 15 of the waste heat boiler 6, there is installed a counterpart 17 for the striker device 14, said counterpart serving as the anvil. Moreover, at the end of the counterpart 17 that is left inside the waste heat boiler 6, there also is installed an impact element 18.

The striker device 14 operates in a similar way as the striker device 8, so that a stroke hit by the striker device 14 to the counterpart 17 moves the counterpart 17 so that the impact element 18 gets into contact with the dust accretions 19 and breaks up the dust accretions 19 attached on the wall of the waste heat boiler 6.

What is claimed is:

1. An apparatus for mechanically breaking up and detaching dust accretions created by process gases and accumulated on the inner walls of a suspension smelting furnace and/or a waste heat boiler permanently connected to the suspension smelting furnace, the apparatus comprising:

at least one linearly-acting striker device utilizing a single linear actuator, the striker device being mounted on the outer surface of the wall of the suspension smelting furnace and/or waste heat boiler, in the vicinity of the connecting point of the suspension smelting furnace and the waste heat boiler, the at least one striker device, creating a mechanical impact effect and mechanical contact between the apparatus and at least one of the dust accretions; and a counterpart for the at least one linearly-acting striker device movably installed in an aperture provided in the wall of the suspension smelting furnace and/or the waste heat boiler to receive strokes caused by the striker device and in order to direct the strokes to the dust accretions accumulated in the suspension smelting furnace and/or waste heat boiler, the counter part for the striker device being installed through the wall of the suspension smelting furnace and/or the waste heat boiler in an aperture provided in the wall, an impact plate attached to the counterpart, the impact plate being installed on an inner side of the wall, aligned with the direction of the wall.

2. An apparatus according to claim 1, wherein the counterpart of the striker device is, at the end that is opposite to the striker device, provided with an impact element.

3. An apparatus according to claim 1, wherein the striker device is arranged to operate pneumatically.

4. An apparatus according to claim 1, wherein the striker device is arranged to operate hydraulically.

5. An apparatus according to claim 1, wherein the striker device is arranged to operate electrically.

* * * * *